US005435474A

United States Patent [19]

Lin

[11] Patent Number: 5,435,474

[45] Date of Patent: Jul. 25, 1995

[54] SCOREBOARD FOR GOLF CARTS

[76] Inventor: Yung-Hsing Lin, No. 8, Alley 30, Lane 371, Hua Cheng Road, Hsinchuang, Taipei Hsien, Taiwan

[21] Appl. No.: 216,269

[22] Filed: Mar. 23, 1994

[51] Int. Cl.[6] ..... B60R 9/00; A63B 55/02

[52] U.S. Cl. ..... 224/274; 224/918; 224/919; 273/32 D; 273/162 A

[58] Field of Search ..... 224/274, 277, 918, 919; 273/32 D, 162 A

[56] References Cited

U.S. PATENT DOCUMENTS

| | | | |
|---|---|---|---|
| D. 195,472 | 6/1963 | Zimmers | 224/274 |
| 1,973,819 | 9/1934 | Link | 224/918 |
| 3,062,422 | 11/1962 | Lord | 224/274 |
| 3,128,021 | 4/1964 | Habbena | 224/274 |
| 3,156,000 | 11/1964 | Westhoff | 224/274 |
| 3,497,118 | 2/1970 | Najjar | 224/918 |
| 3,799,331 | 3/1974 | White | 224/918 |
| 3,830,415 | 8/1974 | Jacobsen et al. | 224/918 |
| 4,157,152 | 6/1979 | Blastic | 224/274 |
| 4,645,105 | 2/1987 | Plumbridge | 224/918 |
| 4,784,305 | 11/1988 | Schoenberg | 224/274 |
| 4,917,282 | 4/1990 | Hufford | 224/274 |
| 5,004,137 | 4/1991 | Wu | 224/274 |

*Primary Examiner*—J. Casimer Jacyna
*Assistant Examiner*—Charles R. Eloshway
*Attorney, Agent, or Firm*—Beveridge, DeGrandi, Weilacher & Young

[57] ABSTRACT

A scoreboard for a golf cart, includes a base plate, a cover sheet and a penholder fastened to the top end of the base plate, the base plate having tapered chambers for carrying golf balls, a smooth writing surface covered by the cover sheet for writing, countersunk holes for fastening to the frame member of a golf cart by screws, a series of tee holes for carrying tees, and four curved partition boards perpendicularly raised from the back side and defining a longitudinal mounting groove in the middle for mounting on the frame member of the golf cart, and two longitudinal golf ball receiving grooves at two opposite sides for receiving spare golf balls, the two outer curved partition boards having each a plurality of circular holes for positioning a respective golf ball.

1 Claim, 5 Drawing Sheets

SCOREBOARD FOR GOLF CARTS

BACKGROUND OF THE INVENTION

The present invention relates to golf carts, and more particularly to the scoreboard of a golf cart which has golf ball receiving grooves on the back side for keeping spare golf balls.

A regular golf cart is generally equipped with a scoreboard on the frame member thereof near the hand grip for posting scores. FIG. 1 illustrates a scoreboard for a golf cart according to the prior art, which is generally comprised of a flat base plate 11, a cover sheet 14 fastened to the flat base plate 11, a mounting hole 13 through the cover sheet 14 and the flat base plate 11 in the center, a tray 12 raised from the flat base plate 11 having two chambers 121 for storing a respective spare golf ball. This structure of scoreboard has only two chambers for storing two spare golf balls. Furthermore, the mounting hole on the cover board and the flat base plate makes the scoring inconvenient.

SUMMARY OF THE INVENTION

It is one object of the present invention to provide a scoreboard for a golf cart which has a smooth writing surface for posting scores. It is another object of the present invention to provide a scoreboard for a golf cart which tapered chambers on the front side and longitudinal golf ball receiving grooves on the back side for carrying spare golf balls. It is still another object of the present invention to provide a scoreboard for a golf cart which has a series of tee holes for carrying tees. It is still another object of the present invention to provide a scoreboard for a golf cart which has a penholder for carrying a pen.

DETAILED DESCRIPTION OF THE PREFERRED EMBODIMENT

Figure 1:
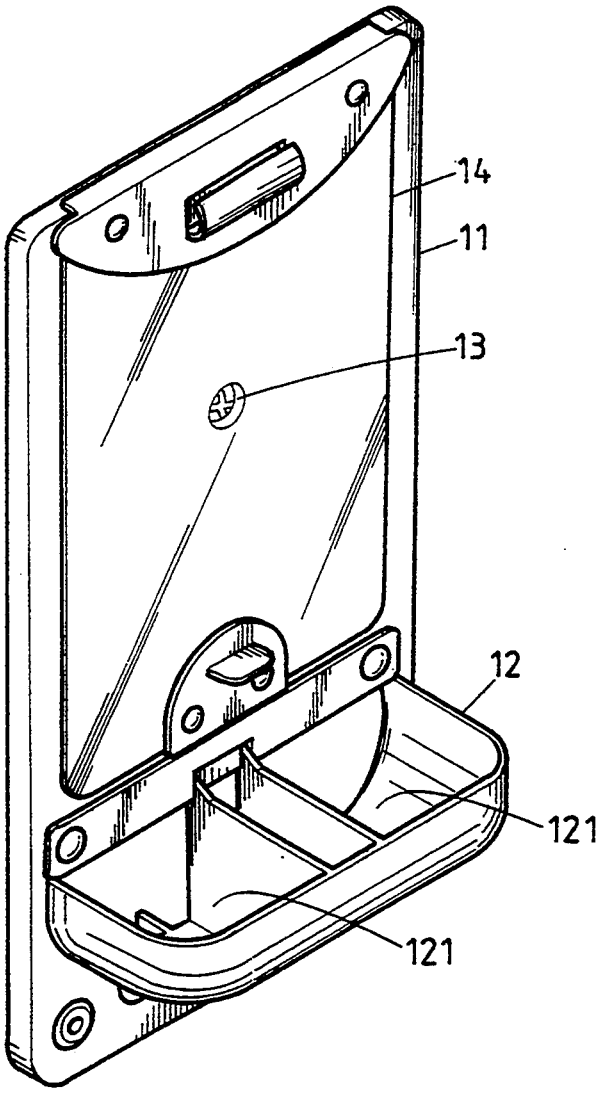
PRIOR ART FIG. 1
FIG. 1 is a front elevation view of a scoreboard for a golf cart according to the prior art.
Figure 2:
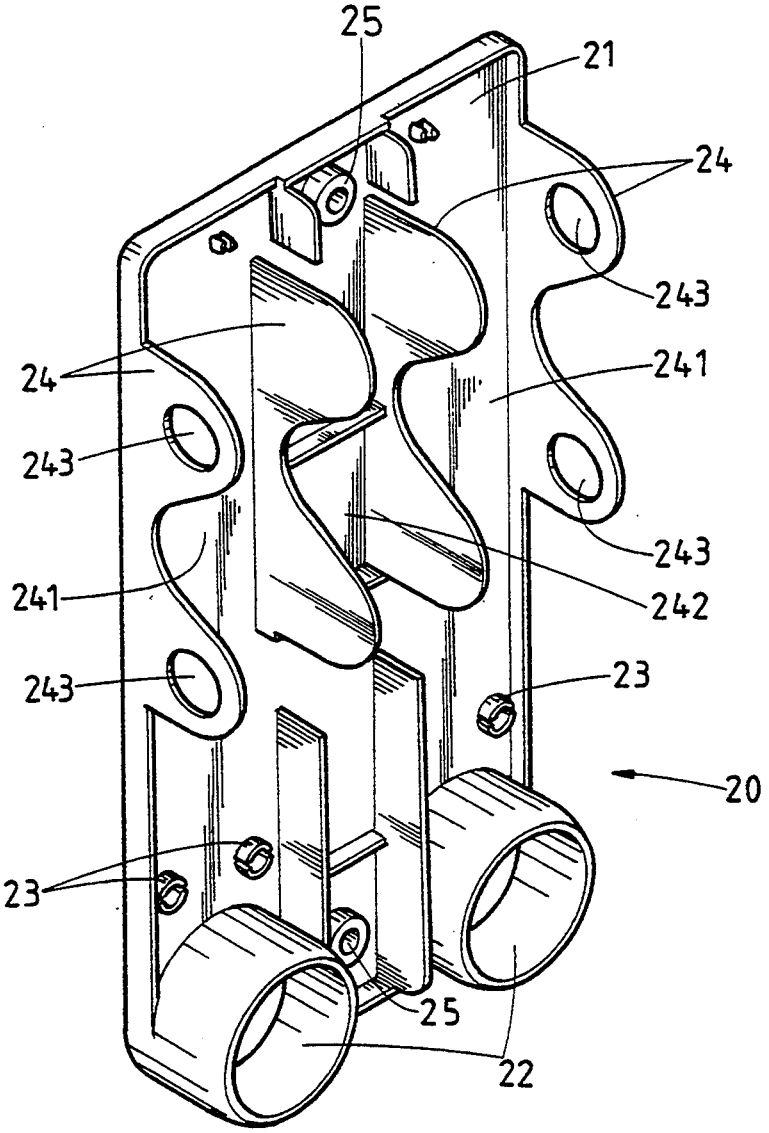
FIG. 2 is a back elevation view of a scoreboard for a golf cart according to the present invention.
Figure 3:
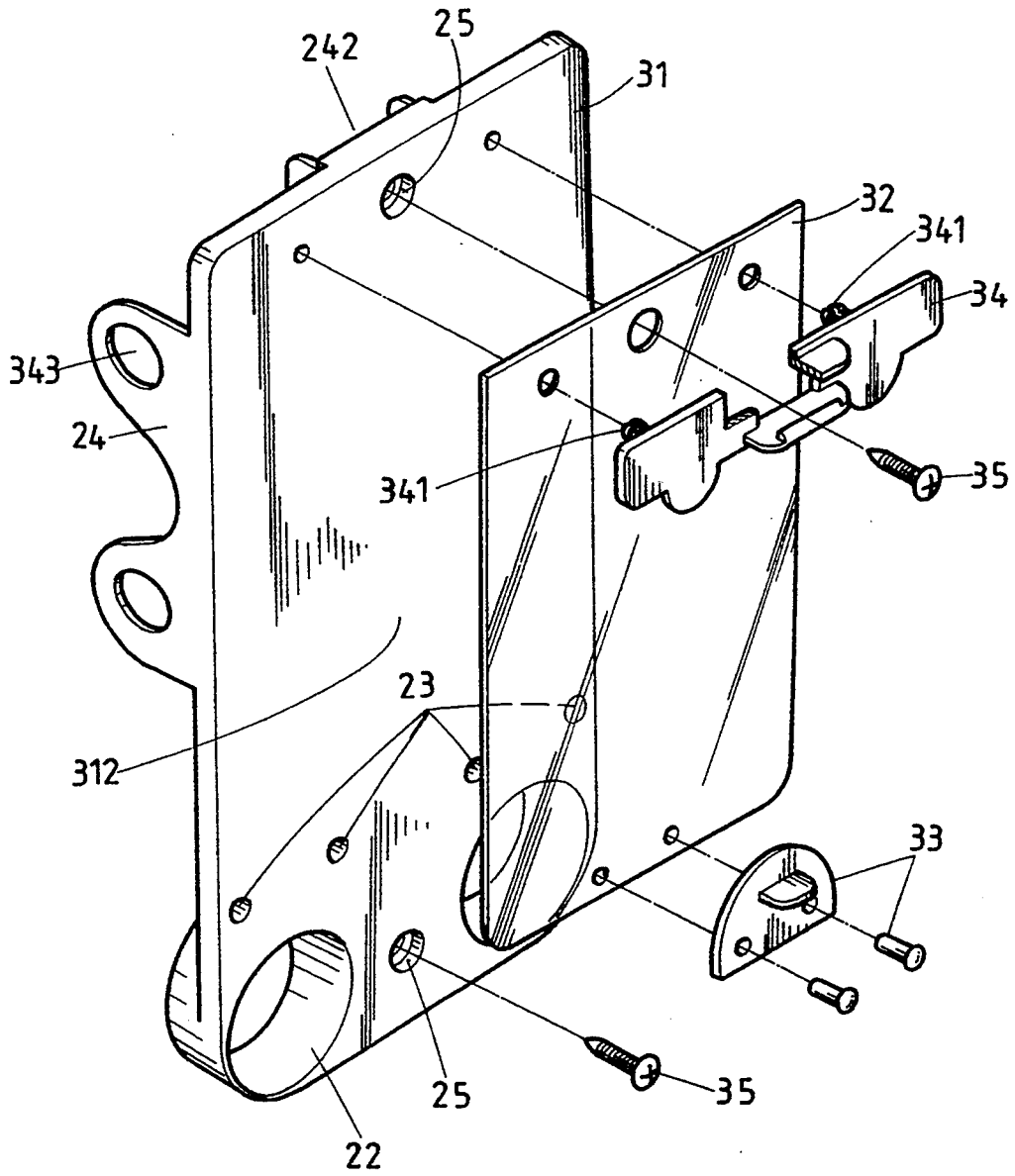
FIG. 3 is an exploded view of the scoreboard shown in FIG. 2.
Figure 4:
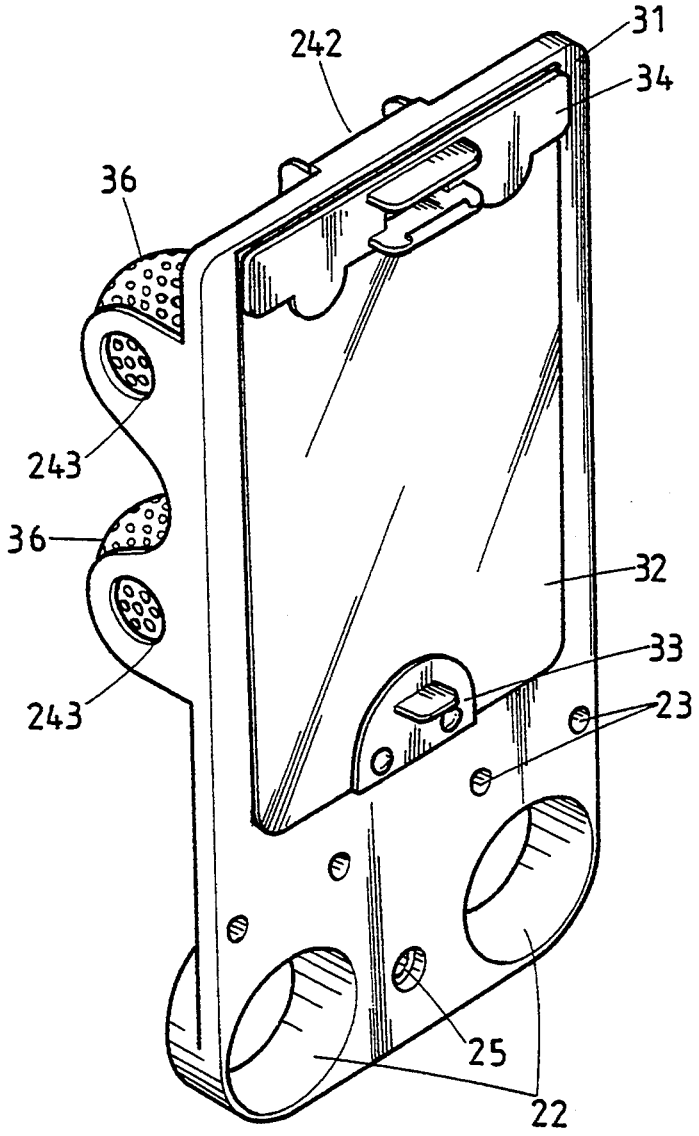
FIG. 4 is a front elevation view of the scoreboard shown in FIG. 2.

Referring to FIGS. 2, 3 and 4, a substantially rectangular scoreboard, referenced by 20, is shown, generally comprised of a base plate 21, a cover sheet 32, and a penholder 34 fastened to the front side 31 of the base plate 21 by fastening elements 341 to secure one side of the cover sheet 32 to the front side 31 of the base plate 21. The cover sheet 32 has an opposite side fastened with a lug 33 for lifting from the base plate 21 by hand.

Referring to FIGS. 2 and 3 again, the base plate 21 comprises two countersunk holes 25 spaced on two opposite ends of the longitudinal center line thereof for fastening to the frame member of the golf cart by screws 35, two tapered chambers 22 bilaterally disposed at the bottom for keeping a respective spare golf ball, a series of tee holes 23 transversely aligned between the tapered chambers 22 and the cover sheet 32 for carrying a respective spare tee. A smooth writing surface 312 is provided on the front side 31 of the base plate 21 and covered by the cover sheet 32 for writing.

Referring to FIG. 2 again, there are four curved partition boards 24 raised from the back side of the base plate 21, defining a longitudinal mounting groove 242 in the middle for mounting on the frame member of the golf cart, and two longitudinal golf ball receiving grooves 241 at two opposite sides by the mounting groove 242 for receiving spare golf balls. The width of the longitudinal mounting groove 242 is approximately equal to the width of the frame member of the golf cart, and therefore the frame member of the golf cart can be fitted into the longitudinal mounting groove 242. The two curved partition boards 24 at two opposite outer sides have a plurality of circular holes 243 for positioning a respective spare golf ball.

Referring to FIG. 4 again, when spare golf balls 36 are inserted into the longitudinal golf ball receiving grooves 241, they are respectively attached to either circular hole 243 and retained in position by the curved partition boards 24. The width of the longitudinal golf ball receiving grooves 241 is made slightly smaller than the diameter of the golf balls, so that the golf balls are clamped in position by the curved partition boards 24 when they are inserted into the longitudinal golf ball receiving grooves 241.

Figure 5:
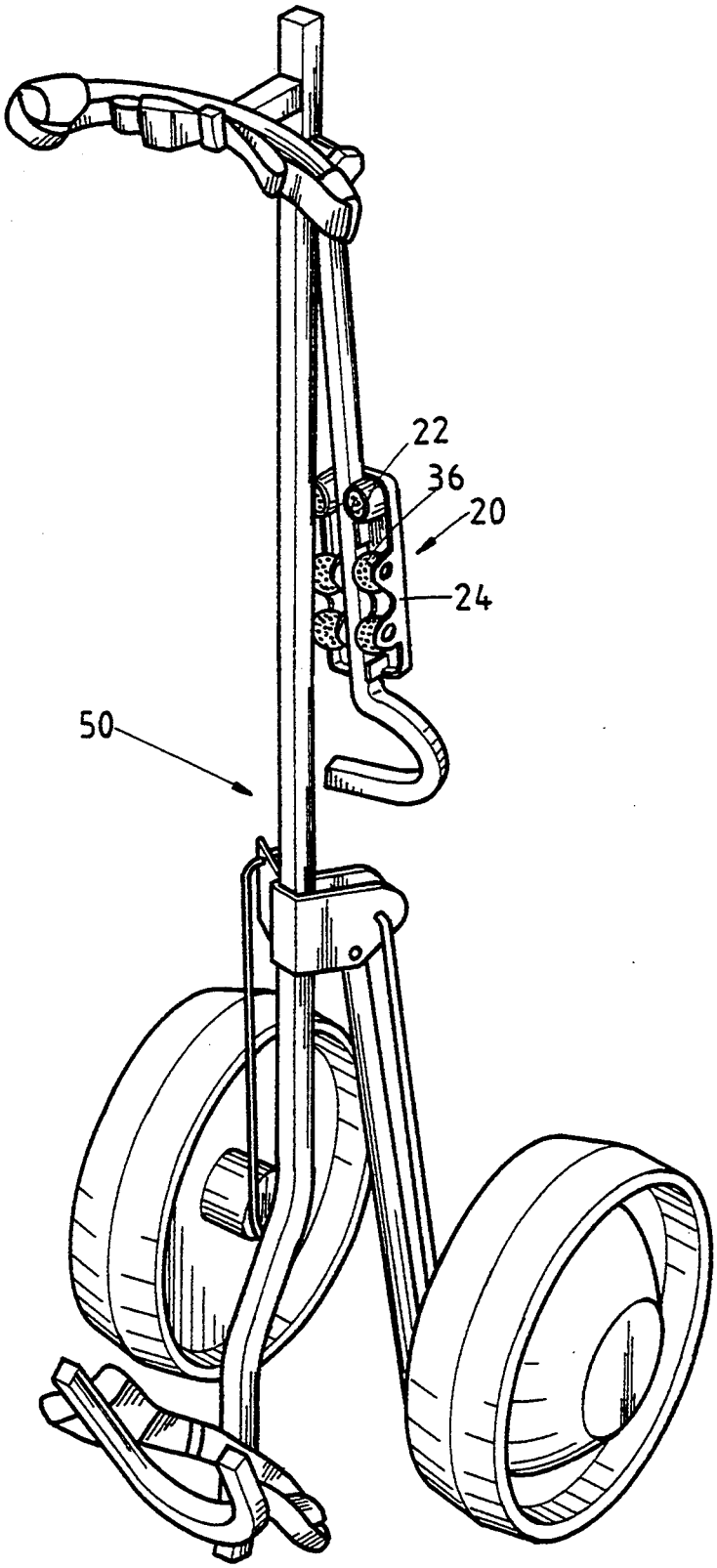
FIG. 5 shows a scoreboard of the present invention installed in the handle of a golf cart.

Referring to FIG. 5, when the scoreboard 20 is fastened to the golf cart 50, spare golf balls can be received in the longitudinal golf ball receiving grooves 241 on the back side of the base plate 21 and concealed from sight.

While only one embodiment of the present invention has been shown and described, it will be understood that various modifications and changes could be made without departing from the spirit and scope of the invention.

What is claimed is:

1. A scoreboard for a golf cart, comprising: a rectangular base plate having a top end fastened to a cover sheet; a pen holder secured to said base plate; two countersunk holes, located at opposite ends of said base plate along a longitudinal centerline thereof, for fastening said scoreboard to a frame member of said golf cart; two tapered chambers disposed on opposite sides of said base plate at a bottom end thereof; said base plate having a smooth top surface covered by said cover sheet for providing a smooth writing surface; a plurality of tee holes for holding golf tees, said holes aligned transversely of said longitudinal centerline and located between said smooth top surface and said tapered chambers; four curved partition boards extending substantially perpendicularly from a bottom surface of said base plate, two of said boards forming a middle mounting groove for mounting said scoreboard on said frame member of said golf cart, the remaining two boards located on opposite edges of said bottom surface and each cooperating with a respective one of said boards forming said mounting groove to form a golf ball receiving groove for receiving spare golf balls; and, said two partition boards located at opposite edges of said bottom surface further including outer curved portions and a plurality of circular holes for positioning said spare golf balls.

* * * * *